US010407233B1

(12) United States Patent
Town et al.

(10) Patent No.: US 10,407,233 B1
(45) Date of Patent: Sep. 10, 2019

(54) ENCLOSURE SYSTEM FOR STORAGE

(71) Applicants: Troy Town, Clinton, LA (US); Derrel Thomas, Clinton, LA (US); Jeffrey Garfinkle, Baton Rouge, LA (US)

(72) Inventors: Troy Town, Clinton, LA (US); Derrel Thomas, Clinton, LA (US); Jeffrey Garfinkle, Baton Rouge, LA (US)

(73) Assignee: Plank Road Technologies, LLC, Baton Rouge, LA (US)

( * ) Notice: Subject to any disclaimer, the term of this patent is extended or adjusted under 35 U.S.C. 154(b) by 0 days.

(21) Appl. No.: 15/489,284

(22) Filed: Apr. 17, 2017

Related U.S. Application Data

(60) Provisional application No. 62/322,990, filed on Apr. 15, 2016.

(51) Int. Cl.

| | |
|---|---|
| ***B65D 81/18*** | (2006.01) |
| ***B65D 88/16*** | (2006.01) |
| ***B65D 88/54*** | (2006.01) |
| ***B65D 90/02*** | (2019.01) |
| ***B65D 81/05*** | (2006.01) |
| ***B65D 85/68*** | (2006.01) |

(52) U.S. Cl.
CPC ..... *B65D 81/18* (2013.01); *B65D 81/05* (2013.01); *B65D 85/68* (2013.01); *B65D 88/16* (2013.01); *B65D 88/542* (2013.01); *B65D 90/021* (2013.01)

(58) Field of Classification Search
CPC ..... B65D 85/68; B65D 88/16; B65D 88/542; B65D 90/021
See application file for complete search history.

(56) References Cited

U.S. PATENT DOCUMENTS

| | | | | | |
|---|---|---|---|---|---|
| 908,983 | A * | 1/1909 | Enyart | B65D 85/68 | 206/335 |
| 982,046 | A * | 1/1911 | Flemming | B65D 85/68 | 206/335 |
| 3,012,688 | A * | 12/1961 | Hine | B65D 85/68 | 217/36 |
| 3,016,623 | A | 1/1962 | Hamilton | | |
| 3,082,899 | A * | 3/1963 | Squier | B65D 88/022 | 160/113 |
| 3,474,803 | A * | 10/1969 | Davis | E04H 6/04 | 135/124 |

(Continued)

FOREIGN PATENT DOCUMENTS

| | | | |
|---|---|---|---|
| GB | 2502249 | A | 11/2013 |
| WO | 2016/022792 | A2 | 2/2016 |

OTHER PUBLICATIONS

PCT Application No. US2015/043996; International Search Report and Written Opinion of the International Searching Authority for Applicant Derrel C. Thomas, et al dated Feb. 2, 2016.

*Primary Examiner* — Kaitlin S Joerger
(74) *Attorney, Agent, or Firm* — Jones Walker LLP

(57) ABSTRACT

A method of loading a flexible enclosure, and the flexible enclosure. The enclosure has a floor, a sealable port, and a top enclosure. The top enclosure has an opening that is sealingly closable with an airtight closure. The method includes the steps of selecting a parking location for the enclosure, and positioning the enclosure over the parking location. Equipment, such as a vehicle is loaded in the enclosure. The enclosure is sealed, and the internal atmosphere of the enclosure is modified, such as lowering the oxygen content of the interior atmosphere.

8 Claims, 2 Drawing Sheets

(56) References Cited

U.S. PATENT DOCUMENTS

| | | | | |
|---|---|---|---|---|
| 3,715,860 | A | 2/1973 | Esty | |
| 3,783,766 | A * | 1/1974 | Boucher | B65D 88/745 150/166 |
| 4,675,030 | A | 6/1987 | Czarnecki et al. | |
| 4,911,317 | A * | 3/1990 | Schloesser | B65D 90/046 220/1.5 |
| 4,930,557 | A * | 6/1990 | Lohse | B65D 85/64 135/117 |
| 5,308,382 | A | 5/1994 | Prasad | |
| 5,419,945 | A * | 5/1995 | Lopez | B25H 5/00 184/106 |
| 6,050,750 | A | 4/2000 | Aoki | |
| 6,113,671 | A | 9/2000 | Garrett | |
| 6,235,087 | B1 | 5/2001 | Chevalier et al. | |
| 6,585,192 | B2 | 7/2003 | Beers | |
| 7,506,776 | B2 * | 3/2009 | Podd | B65D 90/046 220/1.6 |
| 8,141,328 | B2 * | 3/2012 | Villers | B65D 88/1606 53/139.2 |
| 8,418,731 | B2 * | 4/2013 | Kords | B65B 1/16 141/10 |
| 9,061,808 | B2 * | 6/2015 | Echauz | B65D 65/22 |
| 9,895,651 | B2 | 2/2018 | Garfinkle et al. | |
| 2003/0034274 | A1 | 2/2003 | Morita et al. | |
| 2005/0206188 | A1 * | 9/2005 | Wiegel | B60J 11/02 296/98 |
| 2006/0283557 | A1 * | 12/2006 | Neck | B65D 90/021 160/113 |
| 2007/0102428 | A1 * | 5/2007 | Eamcharoenying | B65D 88/62 220/1.6 |
| 2007/0108204 | A1 * | 5/2007 | Warhurst | B65D 7/26 220/6 |
| 2008/0036233 | A1 * | 2/2008 | Wiegel | B60J 11/02 296/98 |
| 2011/0253887 | A1 | 10/2011 | Garfinkle et al. | |
| 2013/0036711 | A1 | 2/2013 | Scudder et al. | |
| 2014/0133952 | A1 * | 5/2014 | Carling | B65D 19/0073 414/800 |
| 2015/0036949 | A1 * | 2/2015 | Lasagna | E04H 6/02 383/14 |
| 2016/0368357 | A1 * | 12/2016 | Lerner | B60J 11/04 |
| 2017/0088343 | A1 * | 3/2017 | Hewlett | B65D 85/68 |

* cited by examiner

ENCLOSURE SYSTEM FOR STORAGE

CROSS-REFERENCE TO RELATED APPLICATION

This application claims the priority benefit of U.S. provisional application No. 62/322,990, filed on Apr. 15, 2016, which is hereby incorporated by reference in its entirety.

BACKGROUND

Flexible enclosure systems for storage of materials where the interior atmosphere in the enclosure has a reduced oxygen content are known in the art. One embodiment of such an enclosure system is disclosed in WO2016022792, hereby incorporated by reference. This publication discloses using an airtight sealable bag to store materials, such as lithium batteries, and then replacing the internal atmosphere in that bag with a low content oxygen atmosphere, to prevent or retard combustion in the enclosure interior. In addition to reducing the oxygen content in the internal bag environment, the water content (humidity) in the internal atmospheric environment may also be reduced by including a dehumidifier or dryer in the system, such as including a dryer in the recirculation system. A similar enclosure and system for replacing the internal atmosphere in the enclosure is disclosed in U.S. application Ser. No. 13/083,189, filed on Apr. 8, 2011 (published as U.S. patent application number 2011025388), hereby incorporated by reference in its entirety. These applications deal with enclosure systems adapted for palletized materials. A large scale enclosure system for storage and or transportation of materials that will be loaded by mechanized equipment, for instance, is needed.

SUMMARY OF THE INVENTION

One aspect of the invention is a large scale flexible sealable enclosure and one or more protective liners deployed on the bottom of the enclosure.

DETAILED DESCRIPTION OF THE INVENTION

One embodiment of the present invention is an enclosure 1 (a flexible bag) and method of using that enclosure, used in conjunction with a vehicle, such as to hold and store a transport vehicle (for instance, a truck, SUV, a tank, a forklift, a trailered boat, artillery pieces, missile launchers, a halftrack, or a helicopter). For instance the bag could be a rectangular box shaped flexible bag having a floor area of 10'×20', or 15'×30', or 10'×10' or 8'×10', or 20'×20' or other large area, with a height of 6', or 8' or 10'-20'. The bag may be a cylindrical shaped bag or a dome shaped bag, with a floor of 10'-20' or larger in diameter, and with heights of 8'-30' feet or larger. The enclosure 1 may be shaped to accommodate the materials stored in the interior, such as drum shaped. The large size enclosure 1 may also be used to store large quantities of supplies, for instance, to store gear in military forward deployment sites that may not be accessed for years. The large size of the enclosure 1 generally entails selecting a suitable location for the enclosure, as once loaded, the enclosure will not be moved (unless, for instance, the enclosure is placed on a flatbed truck for loading (for instance, to store missile batteries), or if the enclosure is positioned in a transport container, such as an intermodal carrier or container, known under a number of names, such as cargo or freight container, ISO container, shipping, sea or ocean container, container van or Conex box, sea or c-can.

Figure 1:
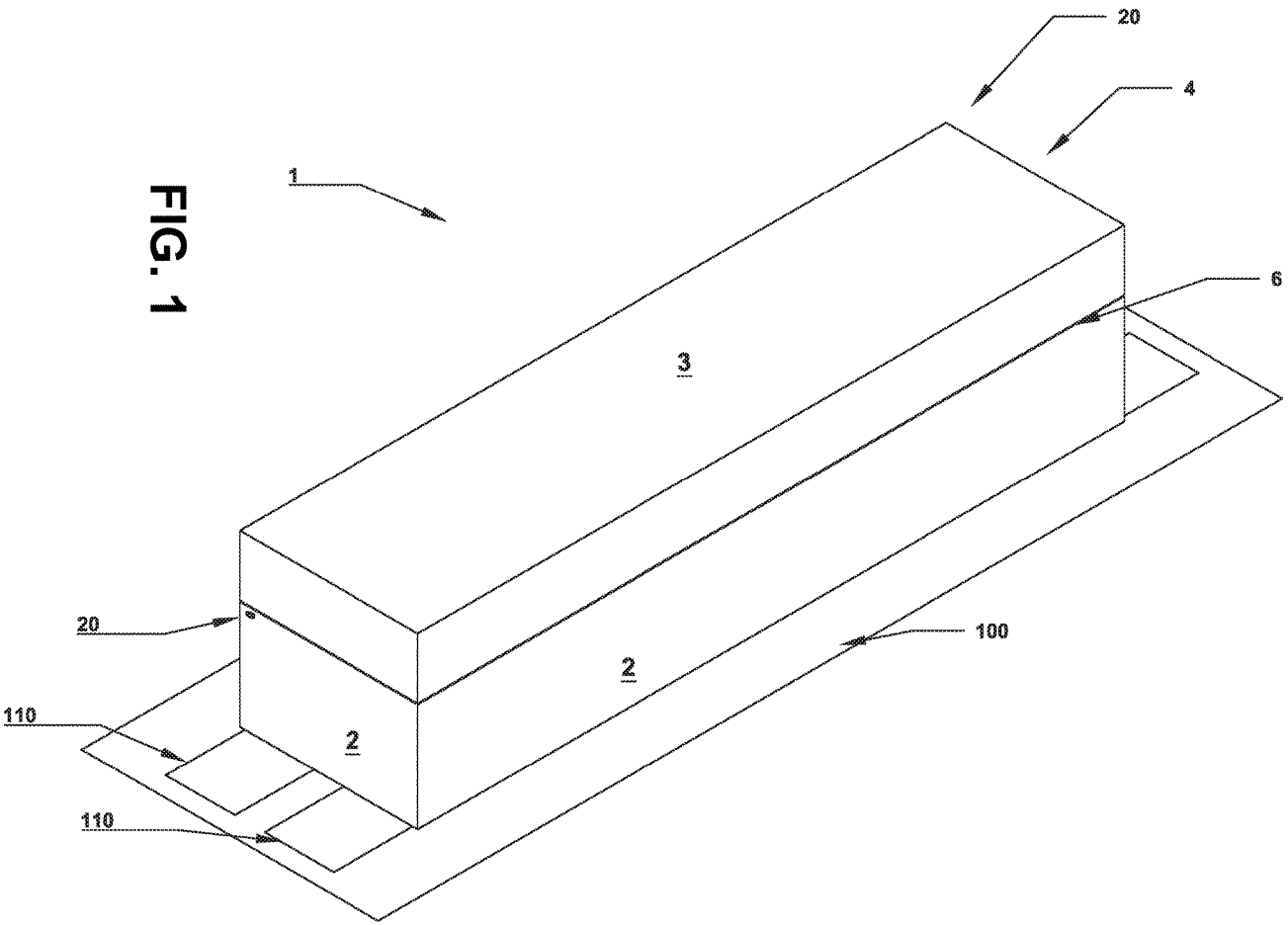
FIG. 1 is a prospective view of the enclosure system in a closed configuration.

The flexible bag 1, in one embodiment, is manufactured using a flexible gas tight fabric, for instance, a coated woven nylon or urethane, polyethylene, polypropylene, polyurethane or other puncture resistant polymer material, such as polyamides. One embodiment uses a 15.5 oz. scrim reinforced polyurethane fabric. The embodiment, shown in FIG. 1, is a box shaped enclosure having a floor 9, sidewalls 2 and a top 3. The enclosure 1 includes a closable "top portion" or top flap 4, and an air tight sealable closure means 6 to sealably close or to open the top portion or top flap. In the embodiment shown, the sealable closure 6 is a zipper made by YKK, LTD (UK), item number 4145692. Other "air tight" zippers can also be used, such as YKK zipper, item number VFWBC-101 SF1TZ Z PU31B BS-NEW2 TS-SEAL U25 WBSEAL2, known as the Aquaseal zipper.

As shown, the zipper 6 is located in a continuous run around three sidewalls or sides of the box shaped enclosure 1. In the embodiment shown, the top portion 4 forms a U-shaped flap and includes portions of the sidewalls 2, where the flap remains attached on one of the sidewalls or endwalls (e.g., the closure or zipper 6 does not encircle the enclosure 1). The zipper 6, when opened, allows the top portion or top flap 4 to be folded back to expose all or a large portion of the enclosure's floor 9. Other sealable closures 6 can be used, such as press seals, slider zip closures, or ziploc type of closures. The zipper 6, as shown, is positioned on the sidewall at a height convenient for ease of access (opening and closing) by an operator. In some embodiments, the zipper or sealable 6 closure may be located near the bottom of the sidewall 2, adjacent the floor 9, the middle of the sidewall 2, or located on the top 3 of the enclosure 1. In other embodiments, the zipper may form a U-shaped opening in the end wall of the rectangular shaped enclosure, that is, on the sidewall of the enclosure. In other embodiments, the sidewall may be missing, for instance, the enclosure has a bottom and top, and opens like a clam shell.

Figure 2:
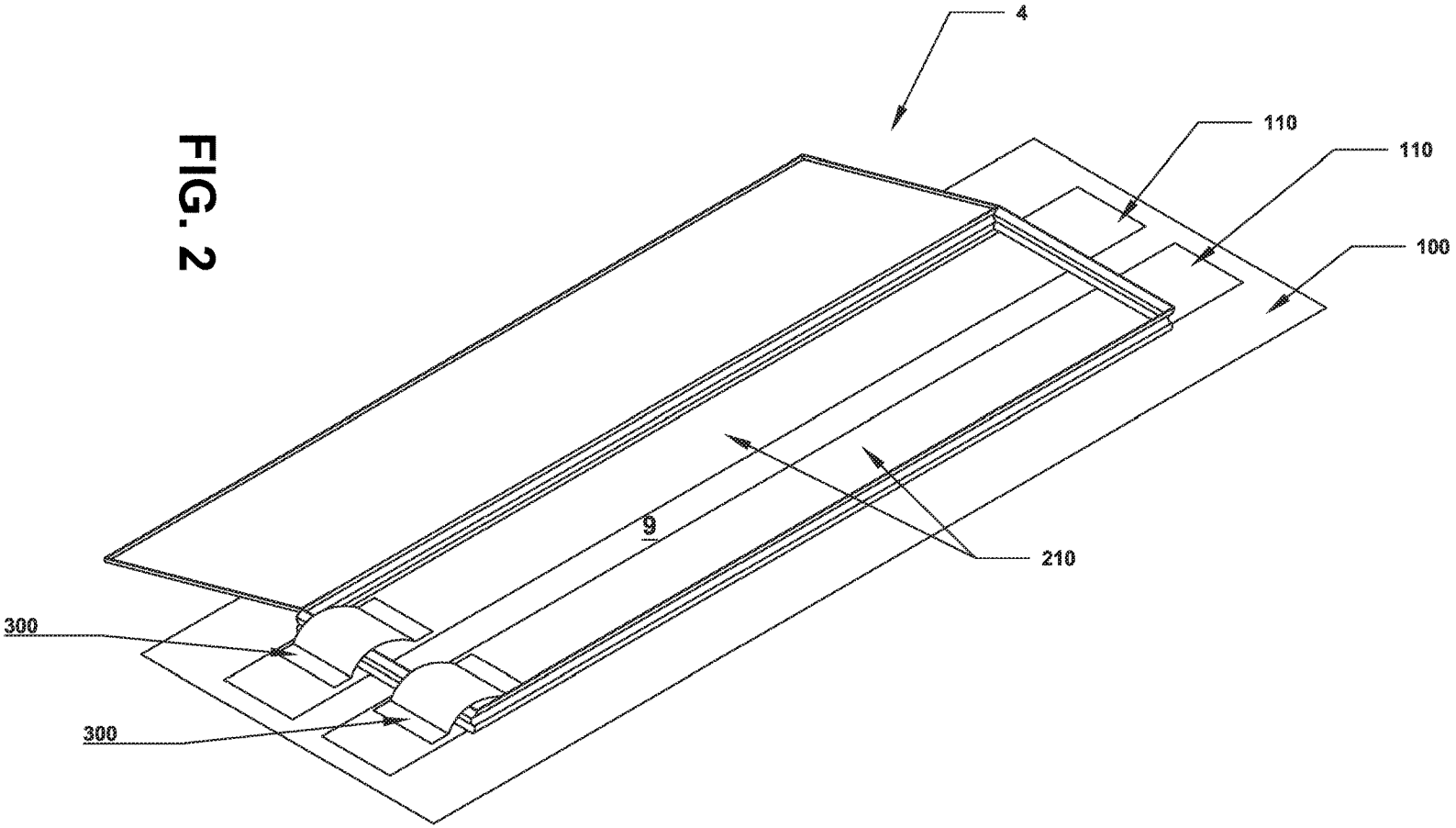
FIG. 2 is a prospective view of the enclosure system in an open and collapsed configuration.

With the top portion 4 opened, the remaining sidewalls 2 collapse and pool or gather at the edges or perimeter of the floor 9, such as shown in FIG. 2. The enclosure includes two sealable ports 20 or openings, generally sealable with a valve. One embodiment of a valve is a D7 inflation/deflation valve from Leafield Marine, LTD, in the United Kingdom. Other valve types may be used. The valve preferably is a low profile, small diameter valve, sealingly mounted to the enclosure 1. Other value types may be used, such as check valves, fill valves, gate valves, ball valves, solenoid valves, Boston valves, poppet valves or other suitable valve type. Preferably, one of the valved openings will be used an evacuation or discharge port, while the second valved opening will be used as a fill or inlet port. Preferably, the two ports are separated on the enclosure, such as located on opposite end walls of a rectangular enclosure additional ports may be used, or fewer. In other embodiments a separate or single port may through the enclosure may be used, where the single port is separately cycled through the exhaust and fill sequences later described.

To use the enclosure 1 to store a vehicle, a storage location or parking location is selected. Once the vehicle or cargo is located in the enclosure, it will generally be stored in place and will not be moved until the enclosure 1 is later opened. That is, the enclosure is not designed to be moved, unless located on or in a movable platform, such as a flatbed trailer or intermodal carrier. With a parking location selected, the supporting substrate (for instance, the ground, or a concrete slab) may need to be prepared for the enclosure 1. Preferably, the parking location is a fairly uniform flat area, but this is not required, because the flexible floor 9 of the enclosure will adapt to the contours of the supporting substrate. On certain supporting substrates, the supporting substrate may be first covered with a ground cover 100, for instance, a flexible puncture resistant fabric such as non-woven (or woven) polypropylene or polyester mat or other geotextile or geosynthetic fabric mat. The geotextile fabric may have additives to stabilize it against UV degradation. Geotextiles are made from a synthetic polymer such as polypropylene, polyester, polyethylene and polyamides, and may be woven, knitted or non-woven. The geotextile fabric can also assist in providing drainage from the underside of the bag or enclosure. One preferred geotextile is 12 oz. non-woven polypropylene.

For instance, if the substrate is a gravel or rocky substrate, the geotextile fabric ground cover 100 helps smooth the surface and acts to "dull" any sharp protrusions that might puncture the enclosure or bag floor. On top of this geotextile ground cover fabric 100, a cushioning mat 110 may be placed to further protect the underside of the enclosure or bag 1. For instance a polyolefin/recycled rubber mat product (thermoplastic rubber), such as Tireplast T60 from B&F Plastics, may be used. The cushioning mat 110 provides a tough cushioning surface to protect the enclosure underside of the enclosure floor from punctures. The mat 110 may cover the entire footprint of the enclosure 1, or may be fabric strips positioned over the expected area of a vehicle's tires or treads, such as shown in FIG. 1. Other cushioning fabrics can be used for the mat 110, such as recycled rubber mats, EDPM polyurethane binder matts (ethylene propylene diene monomer) or ethylene propylene rubber mats, nitrile/PVC foam mats, polyurethane mats, acetal copolymers or acetal homopolymers, etc.

Once the parking surface is prepared, the cargo, for instance a vehicle, will be "parked" in this location in the interior to the bag. The bag 1 is placed over the prepared surface, and the sealable closure 6 is opened. The top portion 4 is folded back to expose most or all of floor area 9 of the bag 1. The sidewalls 2 collapse adjacent the edges of the floor 9, such as shown in FIG. 2. The interior floor 9 surface of the enclosure may also be covered with a cushioning material or mat strips 210, to protect the floor 9 of the enclosure from puncture by the vehicle's tires or treads, for instance, the wheels of a forklift truck used to load cargo in the interior of the enclosure. Finally, if desired, a protective chemically resistant layer may be positioned on the floor surface to protect the bag fabric from vehicle leaks, such as leaks of diesel, gasoline, coolant, salts, etc. A polyvinyl fabric mat may be used, for instance. Alternatively, the chemically resistant fabric or liner may be incorporated into the cushioning fabric 210.

Once the interior floor 9 has been prepared for the vehicle (either a vehicle that will be stored in the interior, or a vehicle used to load cargo in the interior of the enclosure) the vehicle will be rolled or driven (or possibly flown) onto the enclosure floor 9. To protect the collapsed sidewall 2 and zipper 6 at the edge of the enclosure that the vehicle will pass over, a ramp or ramps 300 may be used to bridge over the collapsed zippered sidewall portion. One lightweight ramp is Electriduct Inc.'s (Florida, USA) DO-Max Single Channel Cable Protector ramps. Note, the enclosure system may use all, some, or none of the mats 100, 110 or 210 discussed above. For instance, on a smooth concrete interior substrate floor, the external geotextile ground cover 100, and exterior cushioning mat 110 may not be needed. With the enclosure 1 and interior floor 9 prepared, the vehicle is rolled over the ramps 300 and onto the floor 9 of the enclosure 1.

To load the interior of the enclosure, a forklift, or other mechanized loading vehicle, is driven over the ramp onto the exposed floor of the enclosure, depositing cargo as appropriate (such as loaded pallet) in the interior. The loading vehicle then reverses direction, exiting the enclosure. The process is repeated until all the cargo to be stored in the enclosure is positioned in the enclosure.

In some instances, the enclosure is used to store a vehicle, such as a jeep or halftrack. In this instance, the vehicle is driven over the ramp onto the floor of the enclosure. Once positioned on the floor 9, if the vehicle has sharp edges (if the vehicle is to be stored in the enclosure) those portions of the vehicle (or larger portions of the vehicle) can be optionally covered with a layer of puncture resistant fabric, such as the geotextile fabrics described above. Preferably, the windows/trunk or other closable openings are slightly opened to allow the atmosphere in the vehicle to communicate with the internal bag atmosphere.

The ramp(s) 300 are removed, and the open top flap 4 is then pulled over the vehicle or cargo, and the zipper or sealable closure 6 is sealably closed. The bag 1 has two valves 200, such as check valves, located on the bag, generally spaced far apart (such as on opposite end walls of the bag). The two valves are connected (such as with flexible tubing or conduit, such as 1.5 inch tubing) to a low oxygen system generating system, such as described in WO2016022792 or as described in U.S. application Ser. No. 13/083,189, both incorporated by reference. The low oxygen system generally will be used to: (1) exhaust or vacuum the internal enclosure atmosphere by applying a vacuum or suction, to draw down the interior atmosphere, for instance, to a pressure that is 0.75 psig, or 0.5 psig, or 0.25 psig (an "exhaust sequence"); (2) exhaust or vacuuming ceases, and a source of inert gas (a gas that will not support combustion, which may include a gas with low oxygen content, for instance, a gas having oxygen content less 15% or less than 10% by volume) is provided in a "fill sequence." In some instance, the exhaust sequence and the fill sequence may be undertaken simultaneously such as disclosed in U.S. application Ser. No. 13/083,189. The source of inert gas may be ambient air (or even the enclosure's internal atmosphere), where the oxygen is filtered out, such as with a membrane filter that passes nitrogen but blocks oxygen molecules (for instance, the filter technology available from PCI in Riverside Calif. via its Self Generating Nitrogen Servicing Cart or Station). The inert gas is pumped or flowed into the interior of the sealed enclosure (a "fill sequence") to a desired internal pressure, for instance, to 1.0 psig, or 1.25 psig, or 1.5 psig or −1.0 psig or −2 psig or ambient pressure (e.g., 0.0 psig); and (3) (optional step) interrupt the flow of inert gas, and recirculate or mix the interior atmosphere internally to insure consistency of the atmosphere in the interior (a "recirculation sequence").

Generally, the interior enclosure's oxygen content is monitored (or the inert gas content is monitored) such as by monitoring the recirculating interior atmosphere. The exhaust and fill, or combined exhaust and fill and/or optional recirculation sequences (a "run" or "cycle") may be repeated multiple times until the desired low oxygen content internal atmosphere is achieved. Note that the exhaust and fill sequences may also be combined in a single step. Recirculation may be eliminated, or used, for instance, on the first run only, the first and second runs, etc. Once the enclosure's internal atmosphere reaches the desired oxygen levels, or desired oxygen and humidity levels, the interior volume pressure may be set to the desired psig for long term storage, for instance, by using a final vacuum sequence, or a final fill sequence. The final desired atmosphere may include a desired pressure (such as ambient pressure, or negative psig or positive psig) or a desired volume. Once the desired interior atmosphere is achieved, the low oxygen generating system is removed and the two valved ports are closed, and the parked vehicle/cargo is now conditioned for long term storage, such as for 2 months, 6 months, 12 months or more.

For a helicopter, the enclosure top flap 4 could be opened, and the floor 9 of the bag (or cushioning mat 210, or chemical resistant mat) could have landing markings painted or positioned thereon to assist a pilot to land a helicopter on the exposed floor 9. Once positioned on the floor of the enclosure, the rotors or blades could be removed, and the top flap 4 is sealingly closed (a puncture resistant lining may first be placed over portions of the helicopter to prevent puncturing the enclosure, particularly during a vacuum sequence). For a helicopter or other vehicle storage, it may be desirable to have a completely detachable or almost completely detachable enclosure top portion 4. For long term vehicle storage, components of the vehicle or cargo may be removed prior to storage in the enclosure interior, such as fuel, batteries, coolant, etc. Alternatively, for some enclosures, a single zipper 6 may be located down the top 3 of the enclosure such, for instance, for a cylindrical enclosure, or box shaped enclosure or a dome or igloo shaped enclosure.

The system as described may also be used to store large items that may be dropped in place onto the exposed floor 9 of the enclosure, for instance, with a lifting device such as a crane instead of a forklift. Alternatively, the enclosure as described might be loaded by using a fork lift to load palletized material, (such as ammunition, electronic materials), for instance by driving the forklift onto the exposed floor 9 of the enclosure (over the ramps 300), dropping the pallet, and driving off the exposed floor 9.

In each case, the puncture resistant ground cover 100 may be used, and one of more of the cushioning fabrics 110, 210 may be used or eliminated, as the situation demands.

The enclosure 1 rolls or folds up to a fairly small package for ease of shipping. The mats 100, 110, 210 also roll up to small packages for shipping. Using this enclosure system, in conjunction with a low oxygen generating system, equipment, such as sensitive command, control and communications equipment, may be safely stored in inhospitable environments, such as in caves, jungles, desserts, and high salt environments (near seas and oceans), without the need to store the equipment in an environmentally controlled location. Additionally, hazardous equipment may also be stored in the container, such as bombs and missiles, ammunitions, and chemical stockpiles.

The ground cover, if used, may be integrated with the enclosure or separate. The protective interior material may also be integrated with the interior floor portion of the enclosure or separate.

The invention claimed is:

1. A method of loading a flexible enclosure, the enclosure having a flexible floor, at least one sealable port, and a flexible top, the enclosure further having an opening that is sealingly closable with an airtight closure, the enclosure, when closed and ports sealed forms an airtight enclosure, the method comprising the steps of:

selecting a parking location for the enclosure;

positioning a ground cover over the parking location, where the ground cover comprises a first cushioning material placed on top of a puncture resistant fabric;

positioning the enclosure on top of the ground cover;

opening the enclosure to allow access to the floor of the enclosure;

positioning a second cushioning material on top of the floor;

positioning a ramp over a portion of the sidewall;

moving a vehicle into an interior of the enclosure by moving the vehicle over the ramp and onto the floor of the enclosure;

sealingly closing the opening in the enclosure;

modifying the atmosphere in the interior of the enclosure using the sealable port.

2. The method of claim 1 wherein the second cushioning material is resistant to degradation of gasoline or diesel fuels.

3. The method of claim 1 wherein the vehicle comprises a wheeled vehicle.

4. A method of loading an airtight flexible enclosure, the enclosure having a floor, at least one sidewall, and a top, the enclosure further having a top portion sealingly attached to the enclosure with an openable airtight closure, the method comprising the steps of:

picking a location for the enclosure and positioning the enclosure over the location;

opening the airtight closure;

pooling the sidewall of the enclosure around the perimeter of the floor;

moving the top portion to expose the floor of the enclosure;

positioning a cushioning material on a portion of the floor;

positioning an object onto the floor of the enclosure;

sealingly closing the top portion of the enclosure; and modifying the atmosphere in an interior of the enclosure.

5. The method of claim 4 wherein the airtight closure is a zipper.

6. The method of claim 4 wherein the object is a vehicle positioned onto the floor using a lifting device.

7. The method of claim 4 wherein modifying the atmosphere in the interior of the enclosure results in the atmosphere having an oxygen content less of less than 10% by volume.

8. The method of claim 7 wherein the atmosphere is modified using a membrane filter that passed nitrogen but blocks oxygen molecules.

* * * * *